US012161233B2

(12) United States Patent
Djankovich

(10) Patent No.: US 12,161,233 B2
(45) **Date of Patent: *Dec. 10, 2024**

(54) PORTABLE REBOUNDING DEVICE WITH FORCE ADJUSTMENT ASSEMBLY

(71) Applicant: Rocking Inc., Coral Gables, FL (US)

(72) Inventor: Mladen Djankovich, Coral Gables, FL (US)

(73) Assignee: Rocking Inc., Winnetka, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/236,796

(22) Filed: Aug. 22, 2023

(65) Prior Publication Data

US 2023/0389707 A1 Dec. 7, 2023

Related U.S. Application Data

(63) Continuation of application No. 17/489,515, filed on Sep. 29, 2021, now Pat. No. 11,730,271.

(Continued)

(51) Int. Cl.
*A47C 7/42* (2006.01)
*A47C 7/44* (2006.01)

(Continued)

(52) U.S. Cl.
CPC ..... *A47C 7/441* (2013.01); *A47C 7/425* (2013.01); *A47C 7/445* (2013.01); *A63B 21/00* (2013.01);

(Continued)

(58) Field of Classification Search
CPC ..... A47C 3/02; A47C 7/425; A47C 7/441; A47C 7/445; F16F 1/18; F16F 1/187; F16F 1/22; F16F 1/26; A63B 21/02; A63B 23/0211; A63B 21/026; A63B 21/04; A63B 21/045; A63B 21/055; A63B 21/4047; A63B 23/02
USPC ..... 267/142, 143, 158, 160; 482/121, 122, 482/123, 126, 127, 129, 133, 140; 297/230.1, 230.11, 230.13
See application file for complete search history.

(56) References Cited

U.S. PATENT DOCUMENTS 7,303,232 B1 * 12/2007 Chen ..... A47C 7/38 297/284.7
8,764,110 B2 * 7/2014 Hsuan-Chin ..... A47C 7/44 297/284.7

(Continued)

*Primary Examiner* — Rodney B White
(74) *Attorney, Agent, or Firm* — K&L Gates LLP

(57) ABSTRACT

A rebounding device includes a front member, a rear member, and a spring mechanism including a first biasing element and force adjustment assembly. The force adjustment assembly includes a spring element including a front planar surface and a rear planar surface connected at a rounded portion, wherein the front planar surface contacts an inner surface of the front member; a screw housing secured to an inner surface of the rear member, wherein the screw housing includes a longitudinal channel and a bore on an upper surface; a drive screw positioned through the bore and along the longitudinal channel of the screw housing; a threaded block positioned within the longitudinal channel of the screw housing, wherein the threaded block is configured to move vertically along the longitudinal channel, and wherein the rear planar surface of the spring element is secured to the threaded block.

11 Claims, 14 Drawing Sheets

Related U.S. Application Data

(60) Provisional application No. 63/084,947, filed on Sep. 29, 2020.

(51) Int. Cl.

| | |
|---|---|
| ***A63B 21/00*** | (2006.01) |
| ***A63B 21/02*** | (2006.01) |
| ***A63B 21/04*** | (2006.01) |
| ***A63B 21/045*** | (2006.01) |
| ***A63B 21/055*** | (2006.01) |
| ***A63B 23/02*** | (2006.01) |

(52) U.S. Cl.

CPC ..... *A63B 21/02* (2013.01); *A63B 21/026* (2013.01); *A63B 21/04* (2013.01); *A63B 21/045* (2013.01); *A63B 21/055* (2013.01); *A63B 21/4047* (2015.10); *A63B 23/02* (2013.01); *A63B 23/0211* (2013.01)

(56) References Cited

U.S. PATENT DOCUMENTS

| | | | | |
|---|---|---|---|---|
| 9,446,276 | B2 * | 9/2016 | Araujo | A63B 21/045 |
| 9,687,079 | B1 * | 6/2017 | Grove | A47C 7/445 |
| 10,174,506 | B2 * | 1/2019 | Kim | E04F 15/225 |
| 10,179,261 | B2 * | 1/2019 | Licklider | A63B 21/05 |
| 11,089,875 | B2 * | 8/2021 | Djankovich | A47C 20/027 |
| 11,439,236 | B2 * | 9/2022 | Djankovich | A47C 20/027 |
| 11,730,271 | B2 * | 8/2023 | Djankovich | A63B 21/4047 297/301.1 |
| 2006/0175884 | A1 * | 8/2006 | Jenkins | A47C 7/445 297/300.4 |
| 2013/0345028 | A1 * | 12/2013 | Bes | A63B 22/0056 482/79 |
| 2019/0029432 | A1 * | 1/2019 | Walker | A47C 7/407 |
| 2019/0045933 | A1 * | 2/2019 | Edalati | A47C 7/18 |
| 2022/0287463 | A1 * | 9/2022 | Chan | A47C 7/021 |

* cited by examiner

PORTABLE REBOUNDING DEVICE WITH FORCE ADJUSTMENT ASSEMBLY

CROSS-REFERENCE TO RELATED APPLICATIONS

This application is a continuation of U.S. application Ser. No. 17/489,515 filed Sep. 29, 2021, now U.S. Pat. No. 11,730,271, which incorporates by reference and claims the benefit of priority to U.S. Provisional Application No. 63/084,947 filed Sep. 29, 2020, the entireties of which are incorporated herein by reference.

BACKGROUND OF THE INVENTION

The present subject matter relates generally to a portable rebounding apparatus. More specifically, the present invention relates to a rebounding device to be used against a stationary surface for generating a rebounding motion that includes a mechanism for adjusting the force of the rebounding motion.

Rocking is a familiar part of everyday human life. Numerous proven benefits of rocking have been established for centuries, while modern medicine has discovered new motivations and added reasons for rocking. One of the most well-known uses for rocking is to calm a baby. The gentle bouncing motion mimics the movement the baby felt inside the mother's womb and can soothe infants, aid in lulling children to sleep or while nursing, and reduce crying in colic episodes. Rhythmic motions also help build a better attachment bond between the parent and child, and aids in the growth of the newborn by stimulating both motor and sensory development.

Rocking for personal benefit is a safe activity and option for those that live an otherwise sedentary lifestyle or for people with limited physical motion, including many aging adults, individuals suffering with injuries or chronic ailments, or those seated for long periods of time. The act of rocking has proven benefits such as the easing of arthritis and back pain, improved muscle tone, improved balance, and increased circulation. Studies have shown that patients with Alzheimer's disease that rock regularly demonstrate a significant improvement in depression, anxiety, balance, and a decrease in pain medication usage.

Studies have revealed that rocking causes an increase in psychological well-being for those suffering from dementia, anxiety, and depression due to released endorphins that elevate the mood. Additional studies suggest benefits of rocking can provide comfort and add to the positive treatment of anxiety, attention deficit disorder, attention deficit hyperactivity disorder (ADHD), and autism. For example, studies of patients with ADHD show that rocking movement such as intensity and frequency is correlated with accuracy on cognitively demanding tasks requiring sufficient attention. Studies have also shown that vestibular rehabilitation therapy such as rocking can help patients with vestibular dysfunction, such as vertigo and episodes of dizziness. Rocking may also be a low-energy movement to increase blood flow for those experiencing physical restrictions, such as elderly and those with limited mobility or physical disabilities. Health experts recommend some form of motion to increase circulation and muscle movement when sitting or laying for extended periods. Rocking has also been shown to help people fall asleep faster and improve memory consolidation with more time spent in non-REM sleep.

Rocking can also improve pain management by calming the parasympathetic nervous system. It also improves cognitive processing by soothing the brain and facilitating concentration with the ability to think logically.

However, prolonged rocking in a seated position cannot be performed comfortably without an external device such as a rocking chair to assist in repeating the motion for even a short period of time, let alone hours on end. A continuous rocking motion for long durations without assistance also creates significant strain on muscles and joints. Existing solutions are extremely limited in their embodiments, versatility, and flexibility of use. The operating conditions and other utility requirements often prohibit users from being able to use existing apparatuses when and where rocking assistance is needed most. The use of conventional rocking furniture is limiting in that it cannot easily be moved from room to room or accompany the user during travel.

Further, conventional rocking solutions require a large amount of floor space and are therefore not suitable for use in small rooms and can be difficult to store when not in use. While some hospitals and nurseries equip parents, staff, and caregivers with rockers or gliders, providing a rocker or glider in each room is expensive, which becomes problematic for facilities operating with a limited budget. Smaller options for rocking infants include bassinets, bouncers, or cradles, but in these options the infant is separated from the caregiver, limiting the ability to simultaneously hold, nurse, or easily feed the infant while rocking.

Still further, conventional rocking solutions cannot be combined with other existing furniture such as a sofa or bed, thus preventing users from utilizing such furniture when needing to hold and nurse or calm an infant with rocking. Many mothers prefer to nurse while sitting in an upright position in bed, especially at night, but must choose between the comfort of a bed and the functionality of rocking furniture because nothing exists to allow both simultaneously.

Conventional rocking solutions also present the problem in lacking adaptability to the user of the furniture. For example, a rocking chair may be perfectly comfortable for adult use but may be too strenuous for an elderly person, a person recovering from surgery, a person with limited mobility, a person with physical challenges, etc. The force needed to generate full backwards and forward cycle on a rocker or glider may be easily provided by the leaning back of a larger, heavier body, whereas smaller framed persons, those with pre-existing conditions, and/or aging individuals may need to repeatedly push off the ground using their legs in order to generate motion. With conventional rocking chairs and gliders it can be difficult to achieve partial rock cycles or more subtle motion when the user or child may prefer gentle rebounding rhythm. The size, shape, and condition of the user's body and the personal preference of the user impacts the amount or size of the force needed when utilizing rocking furniture, and a conventional piece of rocking furniture fails to accommodate the variety of needs of multiple users.

Finally, conventional rocking solutions are not adjustable to accommodate various users having different sizes, shapes, and rocking needs. For example, a glider moves in response to the amount of force applied, and a smaller person with less weight may not be able to generate a sufficient rocking force while a larger person with a greater weight may have no problems generating a rocking force. An elderly person may need to generate a rocking motion with even less weight. Therefore one rocking device may not able to provide the appropriate amount of rocking force to a variety of body types and builds.

Accordingly, there is a need for a portable, compressible rebounding device for generating a rocking motion while in a seated position that is adjustable to accommodate the needs of different users, as described herein.

BRIEF SUMMARY OF THE INVENTION

To meet the needs described above and others, the present disclosure provides a rebounding device that includes an adjustable spring mechanism to accommodate the needs of users having different sizes, shapes, and needs. The rebounding device described herein includes a front member and a rear member with a spring mechanism provided therebetween, the spring mechanism including a force adjustment assembly. During use, the user positions the rear member of the rebounding device against a stationary object such as a chair or a wall. The user rests his back against the front member and applies pressure to generate a gentle rocking motion. The rebounding device exerts a biasing force when compressed that gently propels the user's upper body forward while maintaining a seated position. The biasing force is determined in part by the setting of the adjustable mechanism.

In one embodiment, the rebounding device includes a front member, a rear member, and a spring mechanism positioned between the front and rear members. The spring mechanism includes first and second elongate spring elements, each spring element including front and rear planar surfaces integral with a rounded portion. Each spring element operates as a leaf spring with the front and rear planar surfaces moving toward and away from one another about the rounded portion.

Each of the front planar surfaces of each spring element is twisted inwardly toward the rear planar surfaces so as create a curvature for receiving the user's back. The front member is secured to the front planar surfaces of the spring elements and includes a curvature that complements the curvature of the front planar surfaces. The rear member is secured to the rear planar surfaces of the spring element. During use, the user's back rests comfortably against the curved front member and the angled front planar surfaces while the rear member and the rear planar portions rest against the stationary surface.

The force adjustment assembly includes a third spring element that operates as a leaf spring with front and rear planar surfaces moving toward and away from one another, similar to the first and second spring elements. The third spring element moves vertically along the height of the rear member between a lowermost position adjacent to the rounded portions of the first and second spring elements and an uppermost position distal from the rounded portions of the first and second spring elements. The adjustable mechanism includes a guide track secured to an inner surface of the front member and an screw housing mounted on an inner surface of the back member. The guide track on the front member receives the front planar surface of the third spring element during use.

Adjustment is provided by moving the rear planar surface of the third spring element along the length of the screw housing. More specifically, a threaded block is secured to the rear planar surface of the spring element and includes an inner portion that is positioned within and moves along a longitudinal channel of the screw housing. The threaded block may be secured to the rear planar surface via screws or other attachment mechanisms, or may be formed integrally with the spring element.

A drive screw extends through a screw housing cover that is mounted to the screw housing, and extends through a bore in the screw housing cover so that a shaft of the drive screw extends into the channel. The drive screw is secured in place through bearings at opposing ends of the screw. The user can rotate the screw within the channel of the screw housing by rotating a knob attached to an upper end of the drive screw outside of the screw housing.

Within the channel, the shaft of the drive screw extends through a threaded bore within the threaded block such that rotation of drive screw causes the threaded block to move verticalling within the channel. The user manually turns the knob secured to the drive screw to adjust the positioning of the threaded block within the channel, in turn moving the rear planar surface of the third threaded element vertically along the channel as well.

The positioning of the spring element of the force adjustment assembly modifies the rebounding or biasing force provided by the rebounding device. For example, in one example embodiment, the first and second spring elements alone provide a rebounding force of about 25 and 30 lbs. The addition of the third spring element of the adjustable mechanism increases the rebounding force to between 30 and 60 lbs, depending on the positioning of the third spring element of the force adjustment assembly. In other embodiments, the spring mechanism 106 may provide a smaller or greater minimum, maximum, and/or range of rebounding force with and without the force adjustment assembly.

Referring to the embodiment illustrated herein, when the third spring element of the adjustable mechanism is positioned in a lowermost position adjacent to the rounded portions of the first and second spring elements, the added rebounding force is minimal. As the third spring element is gradually moved up to the uppermost position, the amount of additional rebounding force gradually increases. The user can adjust the biasing force using small incremental changes to increase or decrease the pounds of biasing force provided by the device. When the third spring element of the adjustable mechanism is positioned in an uppermost position distal from the rounded portions of the first and second spring elements, the added rebounding force is at a maximum. The device may provide a biasing force that falls within the range of about 30 and 60 lbs, and the adjustable mechanism enables the user to select the precise force appropriate for the specific size, shape, and condition of the body using the device.

In one embodiment, the front and rear members include a front and rear flexible material extending between the pairs of front and rear planar surfaces, respectively, of the first and second spring elements. The front and rear flexible materials are tightly stretched between the front and rear pairs of the front planar portions and the rear planar portions, respectively, of the first and second members so that pressure applied to the material causes the front planar portions to move toward the respective rear planar portions. A foam padding or other thick material may be secured to each of the front and rear members and/or flexible material.

An object of the invention is to provide a solution for adjusting the strength of a bouncing motion provided by a rebounding device, maintaining a smooth bouncing motion throughout the range of strength available.

Another object of the invention is to provide a solution to render a single rebounding device usable for a number of people having different shapes, sizes, and rebounding motion needs.

A further advantage of the invention is that it enables a single rebounding device available for use in a wide variety of settings, from childcare to elder care, etc.

An advantage of the invention is that it provides a portable rebounding device that is easily carried from one location to another, takes up little space, and can be easily stored away when not in use.

Another advantage of the invention is that it can be utilized with almost any existing furniture or supporting surface; thereby allowing the user to rock continuously while holding the infant while sitting wherever they have a supporting surface deemed comfortable.

A further advantage of the invention is that it provides a solution to a need for a rocking motion that is significantly less expensive than conventional rocking solutions.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
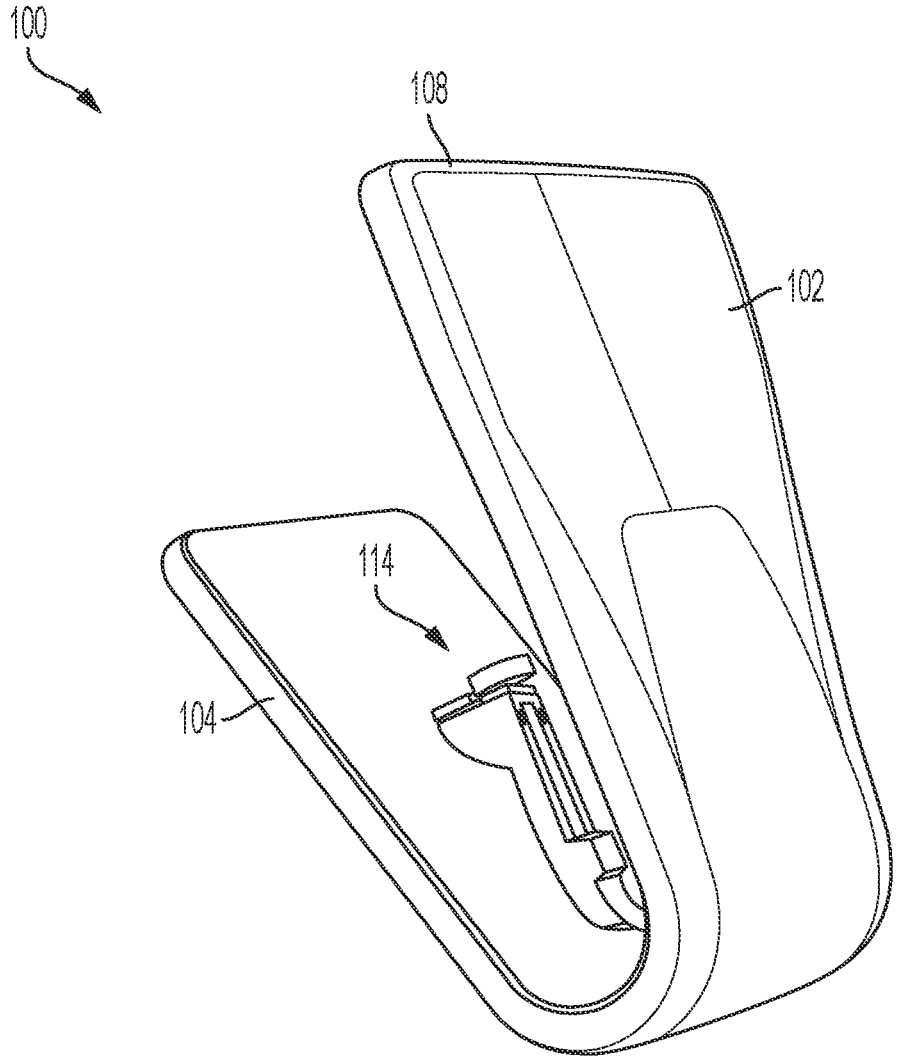
FIG. 1 is a front, perspective view of a rebounding device including a force adjustment assembly of the present application, illustrating an outer casing.

FIGS. 1-23 illustrate an example embodiment of a rebounding device 100. As shown in FIGS. 1 and 7, the rebounding device 100 includes a front member 102, a rear member 104, and a spring mechanism 106 positioned between the front and rear members 102, 104 within an outer casing 107. In the illustrated embodiment, the spring mechanism 106 includes first and second spring elements 110, 112 and a force adjustment assembly 114.

Figure 5:
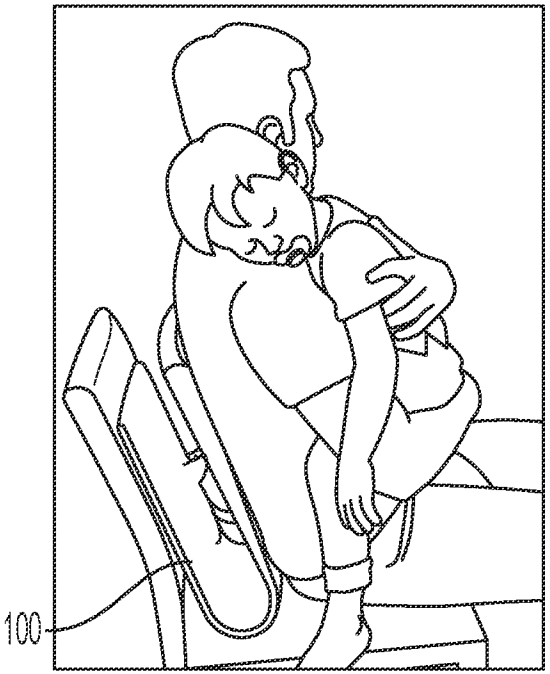
Figure 6:
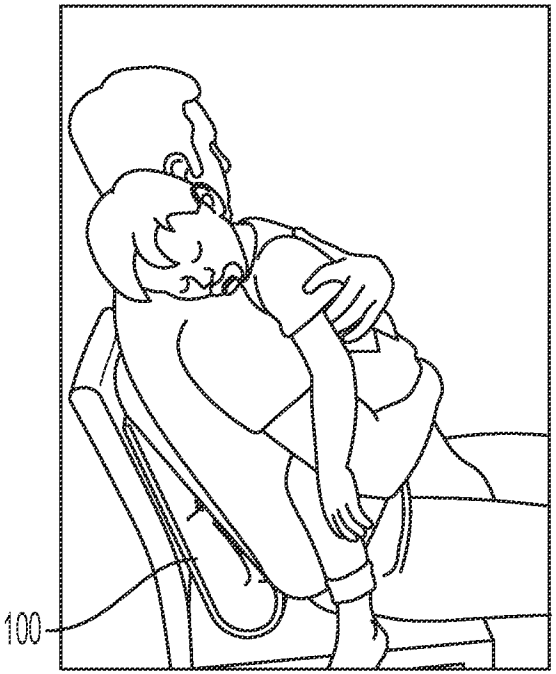
Figure 7:
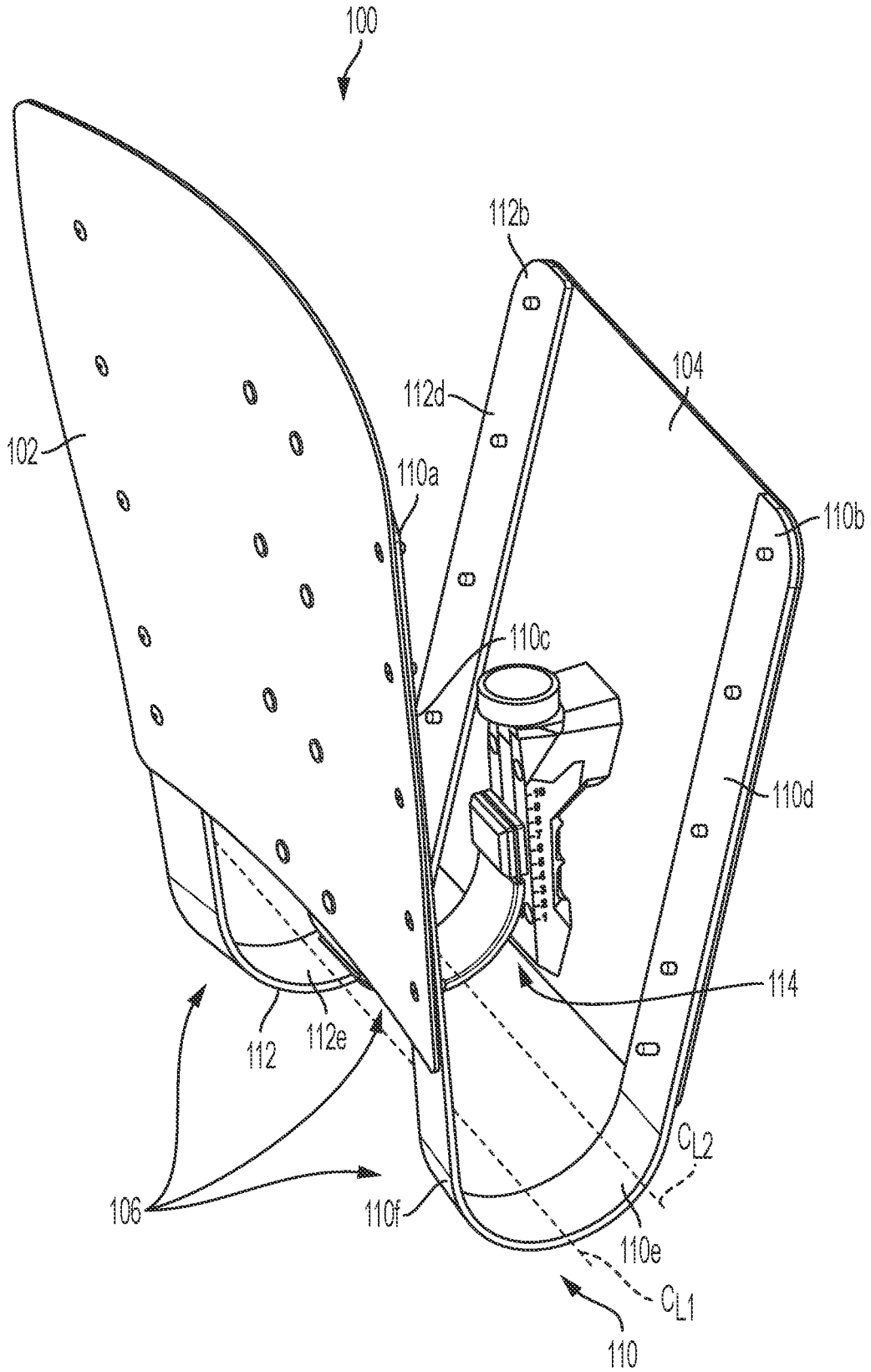
FIG. 7 is a front, perspective view of the internal components of the rebounding device with force adjustment assembly of FIG. 1.
Figure 8:
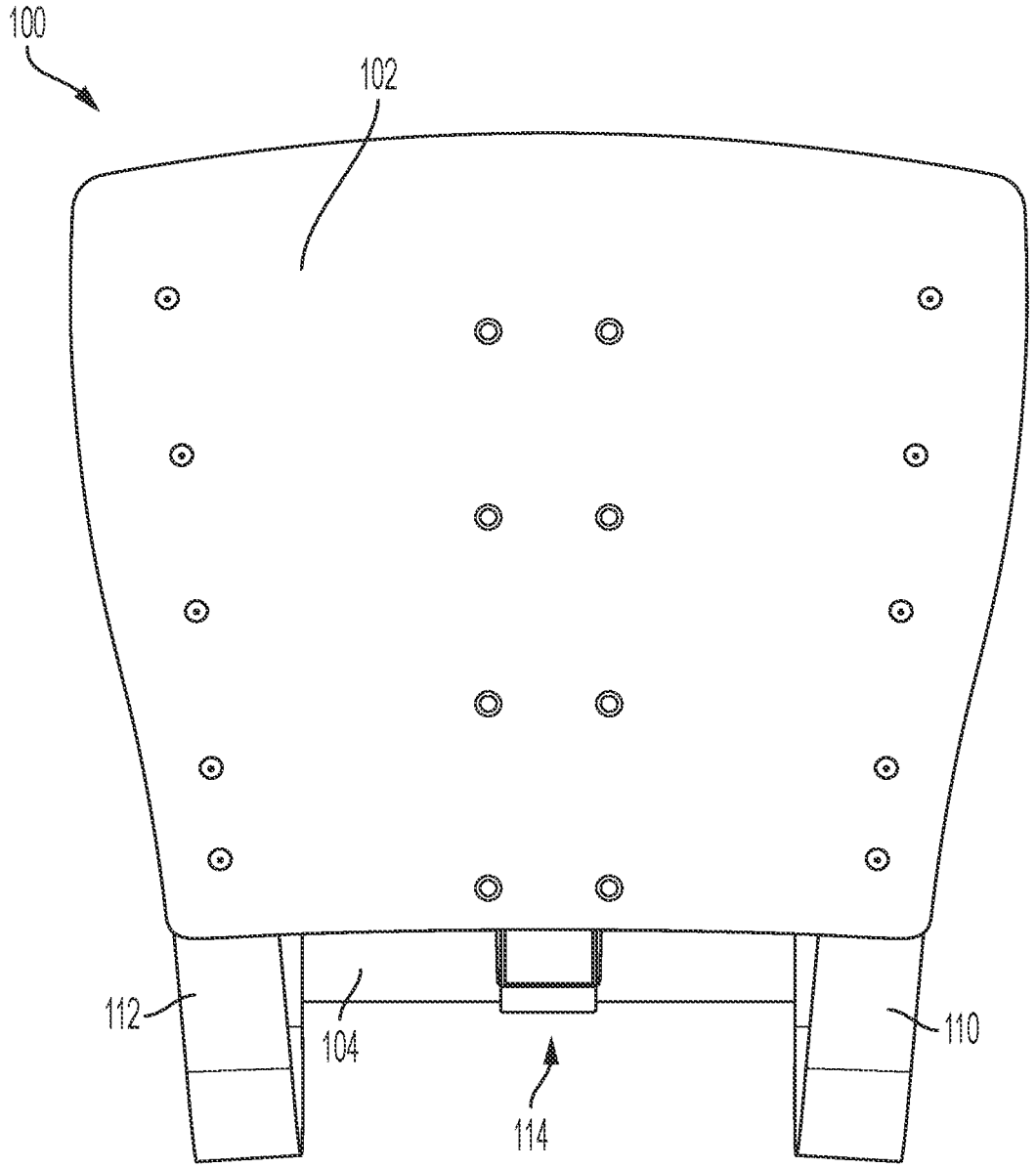
FIG. 8 is a front elevational view of the internal components of the rebounding device of FIG. 1.
Figure 9:
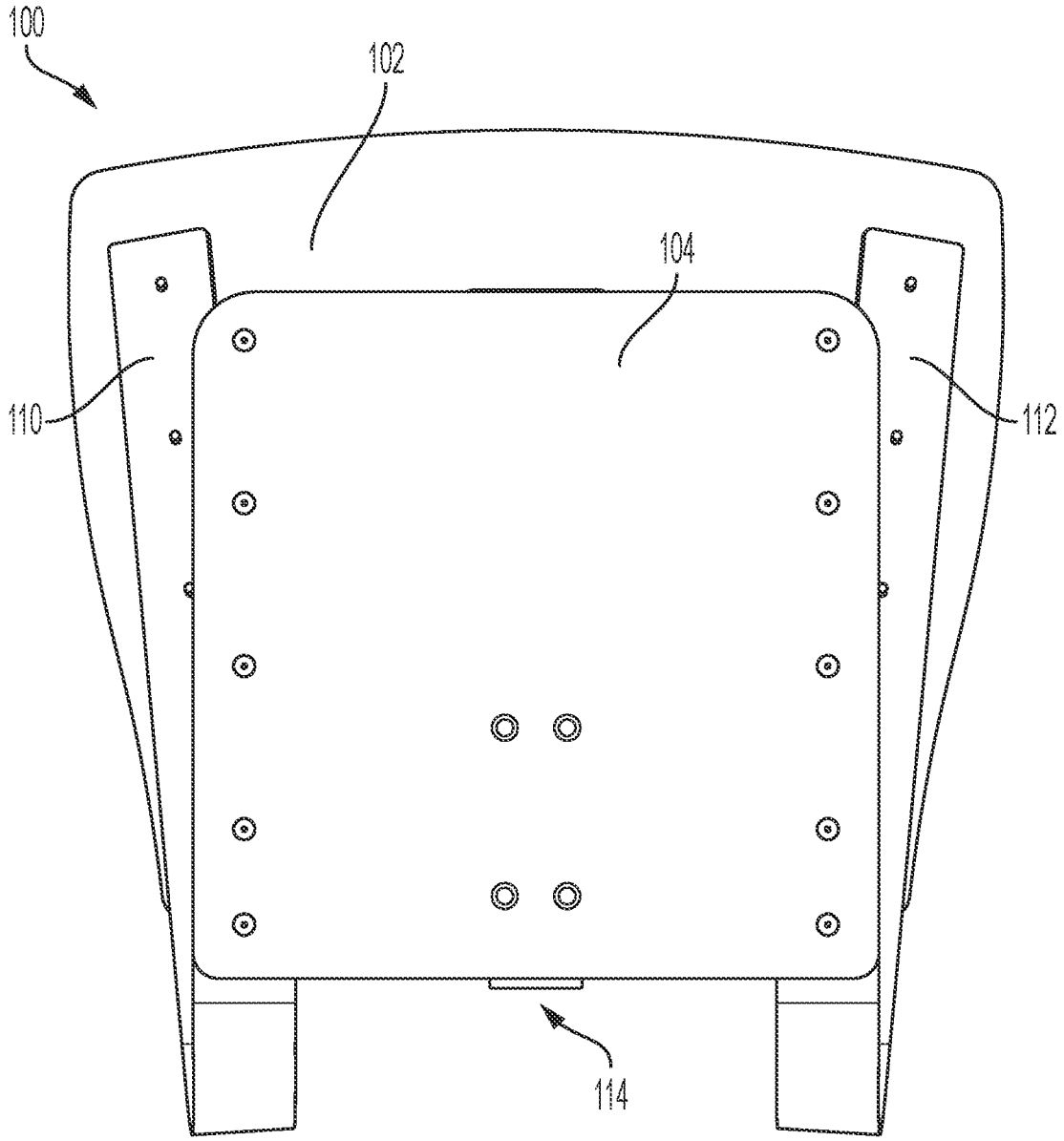
FIG. 9 is a back elevational view of the internal components of the rebounding device of FIG. 1.
Figure 10:
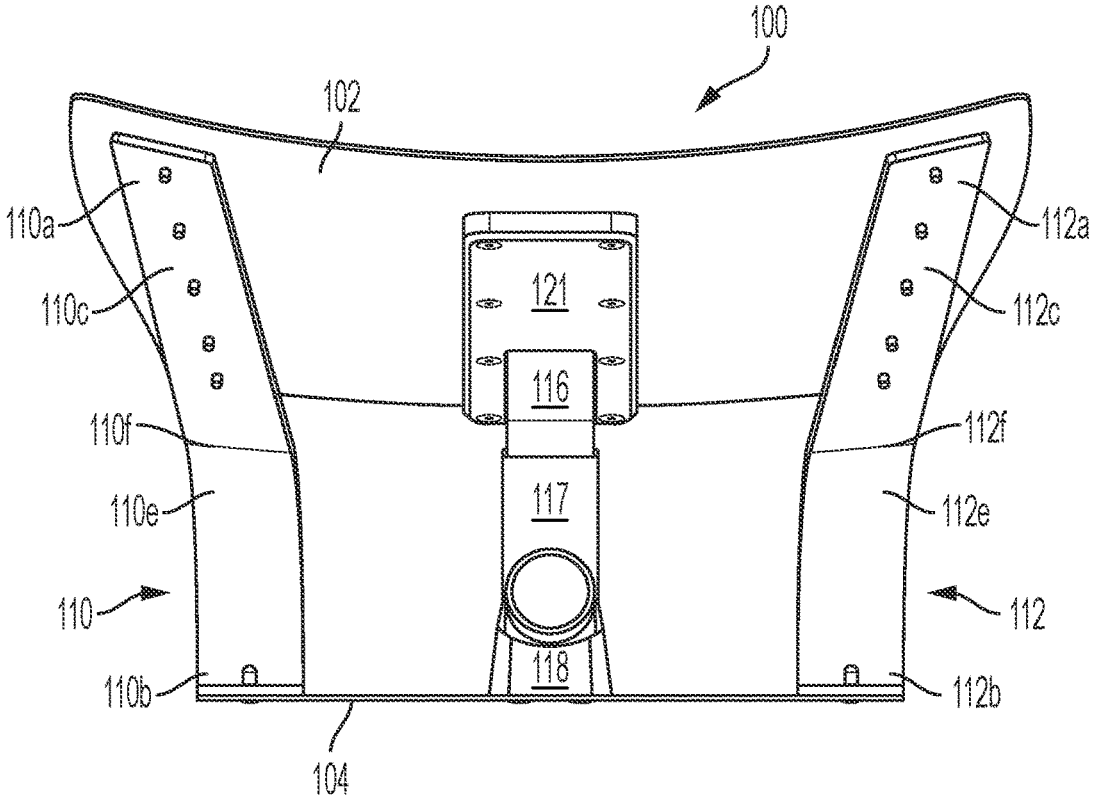
FIG. 10 is a top plan view of the internal components of the rebounding device of FIG. 1.
Figure 11:
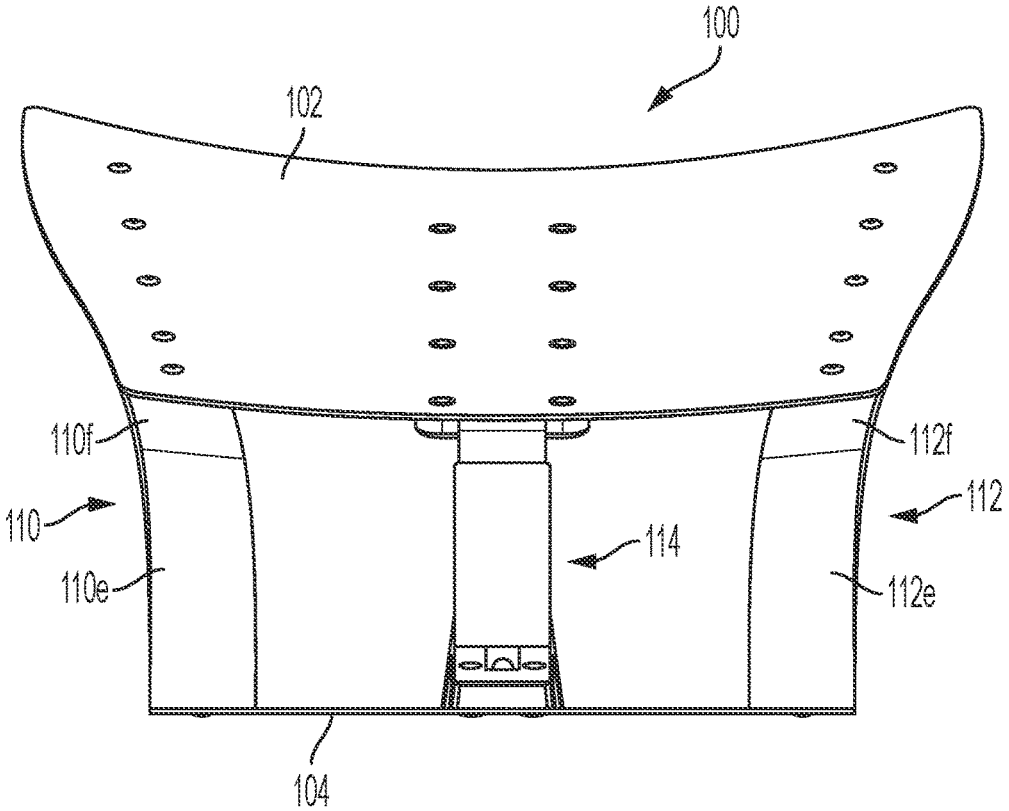
FIG. 11 is a bottom plan view of the internal components of the rebounding device of FIG. 1.

During use, the rear member 104 rests against a solid surface as shown in FIGS. 5-7. The user positions his back against the front member 102 and applies pressure to create a gentle, rocking motion. The user positions the rebounding device 100 between his back and a supporting surface such as the headboard of a bed, the back of a sofa, an airplane seat, or a wall. The rebounding device 100 exerts a biasing force through the spring mechanism 106 when compressed that propels the user's upper body forward while maintaining a seated position. The combination of the biasing force of the rebounding device 100 against the weight of the user generates a momentum that allows continued bouncing while rocking an infant or oneself for personal relaxation, activity, or comfort, while requiring little effort for hours on end. The spring mechanism 106 of the rebounding device 100 shown includes a force adjustment assembly 114 that enables the user to adjust the amount of rebounding force provided by device 100, as described in greater detail below.

FIGS. 7-23 illustrate the internal components of the rebounding device 100. Seen most clearly in FIGS. 7, 10, and 11, the front member 102 has a concave curvature between the first and second spring elements 110, 112. The rear member 102 is planar between the first and second spring elements 110, 112. Each of the front and rear members 102, 104 may be metallic, such as aluminum, plastic, or any suitable material. In other embodiments, a single spring element or more than two spring elements may be used.

Figure 12:
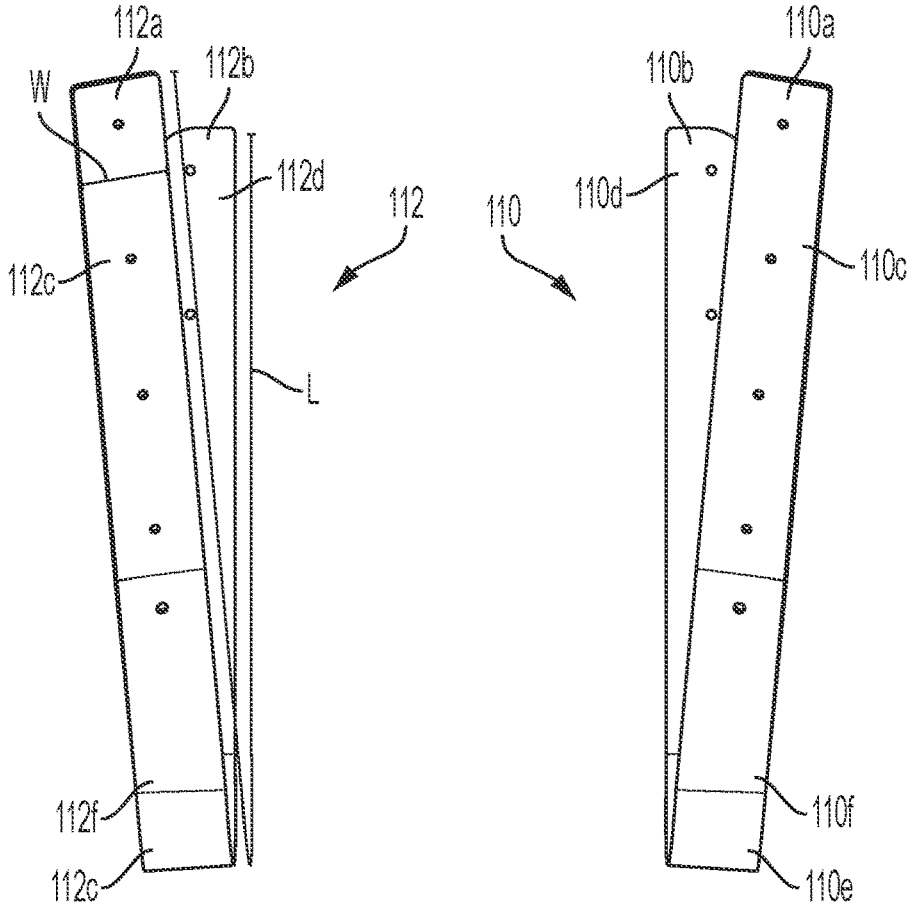
FIG. 12 is a front elevational view of the first and second spring elements of the rebounding device of FIG. 1.
Figure 13:
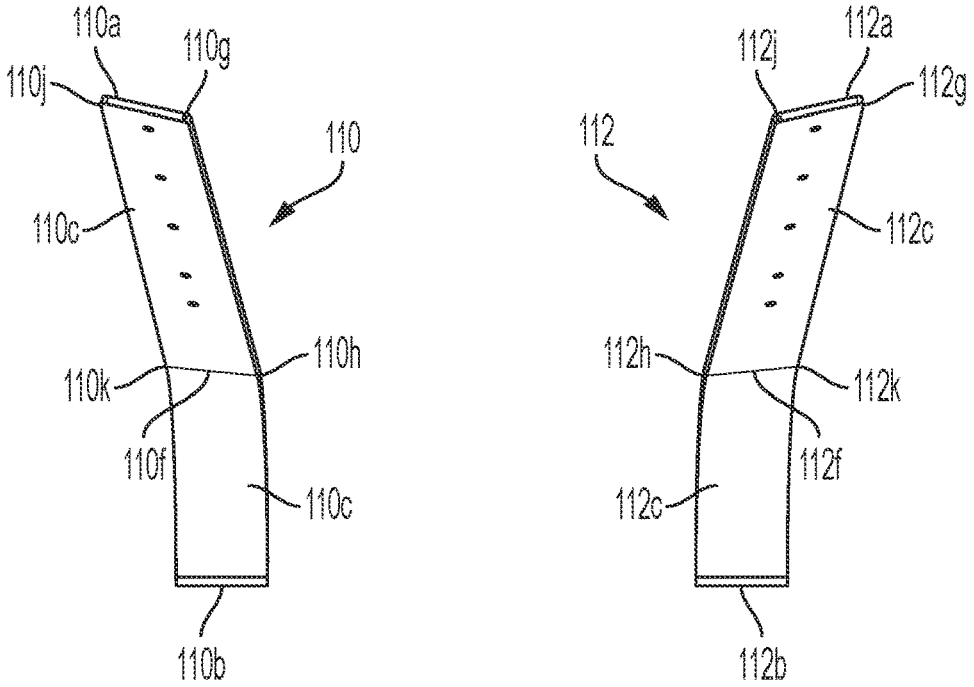
FIG. 13 is a plan view of the first and second spring elements of the rebounding device of FIG. 1.
Figure 14:
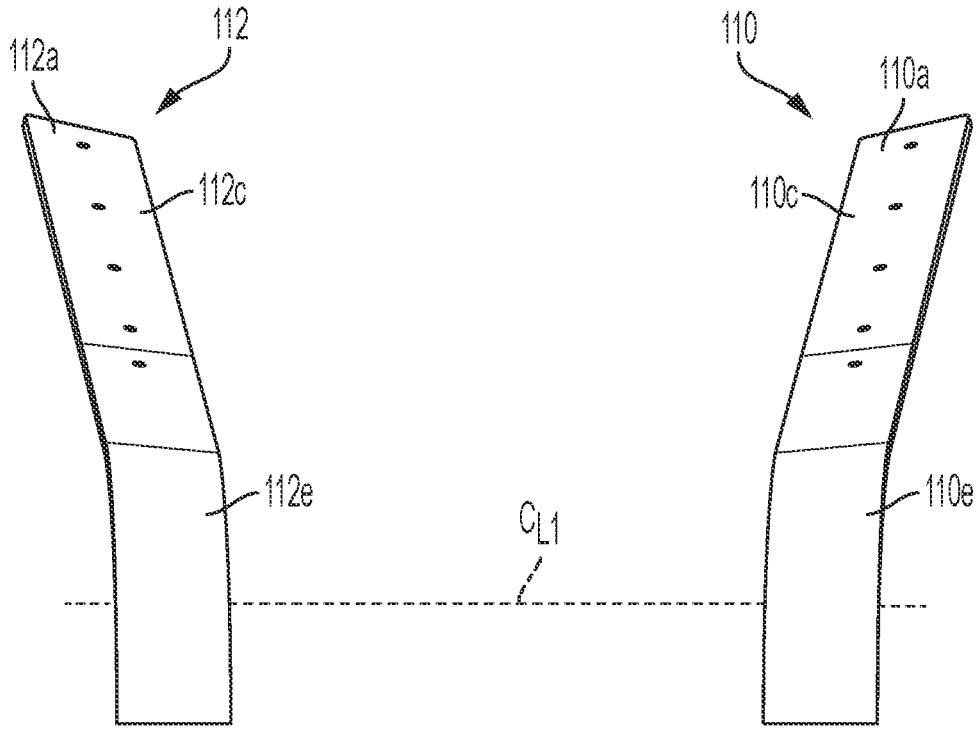
FIG. 14 is a bottom plan view of the first and second spring elements of the rebounding device of FIG. 1.

FIGS. 12-14 illustrate the curvature of the spring elements 110, 112. Each of the first and second spring elements 110, 112 has an elongate shape including a length L and a width W, the length L being greater than the width W, and extending between a front end portion 110*a*, 112*a* and a rear end portion 110*b*, 112*b*. Each elongate spring element 110, 112 curves around an axis $C_{L1}$. The axis $C_{L1}$ is parallel to the width of each spring element 110, 112 along the rear end portions 110*b*, 112*b* and is spaced apart from a midpoint along the length L, separating the length L of the spring element 110, 112 into a front planar surface 110*c*, 112*c* and a rear planar surface 110*d*, 112*d* by a rounded portion 110*e*, 112*e*. The front planar surfaces 110*c*, 112*c* and the rear planar surfaces 110*d*, 112*d* extend adjacent to but slightly angled away from each other when in a resting position. The rounded portion 110*e*, 112*e* functions as the spring leaf mechanism that enables the rebounding device 100 to provide a rebounding motion.

Best seen in FIGS. 12 and 13, the front end 110*a*, 112*a* of each front planar surface 110*c*, 112*c* is twisted relative to a juncture 110*f*, 112*f* at which the front planar surface 110*c*, 112*c* meets the rounded portion 110*e*, 112*e*. Each inner edge 110*g*, 112*g* of each front end 110*a*, 112*a* is twisted inwardly toward the respective rear planar surface to form a cradle for receiving the back of the user as shown in Fig. X. Each outer edge 110*j*, 112*j* of each front end 110*a*, 112*a* is twisted outwardly away from the respective rear planar surface to further form the cradle.

Shown in FIG. 7, the rear planar surfaces 110*d*, 112*d* of each spring element 110, 112 are flat and co-planar relative to each other in order to apply an equal distribution of pressure onto the stationary surface. During use, the user's back rests comfortably against the front member 102 and angled front planar surfaces 110*c*, 112*c* while the rear planar surfaces 110*d*, 112*d* rest against the stationary surface.

In one embodiment, each elongate spring element 110, 112 may have a width W that ranges between about 1.5 in. and about 2.5 in., although the width may vary as desired and may vary throughout the length L. Each spring element 110, 112 may also have a thickness T that ranges between about 0.125 in. and about 0.25 in., created by a single layer or multiple, stacked layers. In the illustrated embodiment, the width W and thickness T of the spring elements 110, 112 vary along the length L, having smaller values at the rounded portions 110*e*, 112*e* than at the front and rear ends 110*b*, 112*b*. In other embodiments, the width W and thicknesses T of the spring elements 110, 112 vary based on manufacturing processes and/or as desired.

The first and second spring elements 110, 112 may be comprised of any material that provides sufficient elasticity to enable repeated rebounding motions while being sufficiently strong to structurally support a person's weight. Example metallic materials include aluminum, an aluminum alloy preferably but not necessarily having a T6 temper, such as 6061T6, steel, and a steel alloy such as AISI 5160. The device may also be made of plastic such as polyvinyl chloride, a carbon fiber composite material, or a wood material.

Referring to FIGS. 7 and 15-23, the spring mechanism 106 of the illustrated embodiment also includes a force adjustment assembly 114 positioned at a mid-point along the width of the front and back members 102, 104 between the first and second spring elements 110, 112. The force adjustment assembly 114 includes a third spring element 116 similar to the first and second spring elements 110, 112. The third spring element 116 has an elongate shape including a length L and a width W, the length L being greater than the width W, and extending between a front end 116*a* and a rear end portion 116*b*. The length of the third spring element 116 curves around an axis $C_{L2}$ that is parallel to $C_{L2}$ as shown in FIG. 7 and is spaced apart from a midpoint along the length L, separating the length L of the third spring element 116 into a front planar surface 116*c* and a rear planar surface 116*d* by a rounded portion 116*e*. The front planar surface 116*c* and the rear planar surface 116*d* extend adjacent to but slightly angled away from each other when in a resting position.

The rounded portion 116*e* of the third spring element 116 functions as an additional spring leaf mechanism that provides additional rebounding force to the rebounding force provided by the first and second spring elements 110, 112. This positioning of the third spring element 116 modifies the strength or biasing force of the rebounding device 100 by adding to the force applied by the first and second spring elements 110, 112.

The rounded portion 116*e* may include a reinforcing spring element 117 secured thereto. The reinforcing spring element 117 has a length that extends along the rounded portion 116*e* of the spring element 116. In one embodiment, the reinforcing spring element 117 is welded or otherwise secured to the rounded portion 116*e*.

In one embodiment, the first and second spring elements 110, 112 alone provide a rebounding force of about 27 and 30 lbs. The addition of the third spring element 116 of the force adjustment assembly 114 increases the rebounding force to between 30 and 60 lbs when the third spring element 116 is in the lowermost and uppermost positions, respectively.

When the third spring element 116 is positioned in the lowermost position, the rebounding device 100 operates primarily using the first and second spring elements 110, 112 only because a significant amount of force is needed to engage the third spring element 116. With the central axis $C_{L2}$ of the rounded portion 116*e* of the third spring element 116 aligned with the central axis $C_{L1}$ of the rounded portions 110*e*, 112*e* of the first and second spring elements 110, 112, the third spring element 116 is most difficult to reach. A minimal amount of additional rebounding force is provided at this positioning.

As the third spring element 116 is gradually moved up to the uppermost position, the amount of additional rebounding force gradually increases. When the third spring element 116 is in the uppermost position, a maximum amount of additional rebounding force is provided. When the central axis $C_{L2}$ of the rounded portion 116*e* of the third spring element 116 is at the greatest offset from the central axis $C_{L1}$ of the rounded portions 110*e*, 112*e* of the first and second spring elements 110, 112, the rounded portion 116*e* of the third spring element 116 can provide the maximum among of additional rebounding force.

The user can adjust the biasing force using small incremental changes to increase or decrease the pounds of biasing force provided by the force adjustment assembly 114. The force adjustment assembly 114 enables the user to select the precise force appropriate for the specific size, shape, and condition of the body using the device.

In other embodiments, the spring mechanism 106 may include first and second adjustability mechanisms on the first and second spring elements 110, 112 with or without the addition of the force adjustment assembly 114. Each of the first and second spring elements may comprise, for example, an adjustable torsion spring with a preloaded setting attached to a rotatable knob. In some embodiments, the adjustable torsion spring is secured to the elongate element 110, 112 through a frame mounted thereto. In other embodiments, the adjustable torsion spring is provided in lieu of the elongate element 110, 112 and secured to the front and rear members 102, 104.

Figure 15:
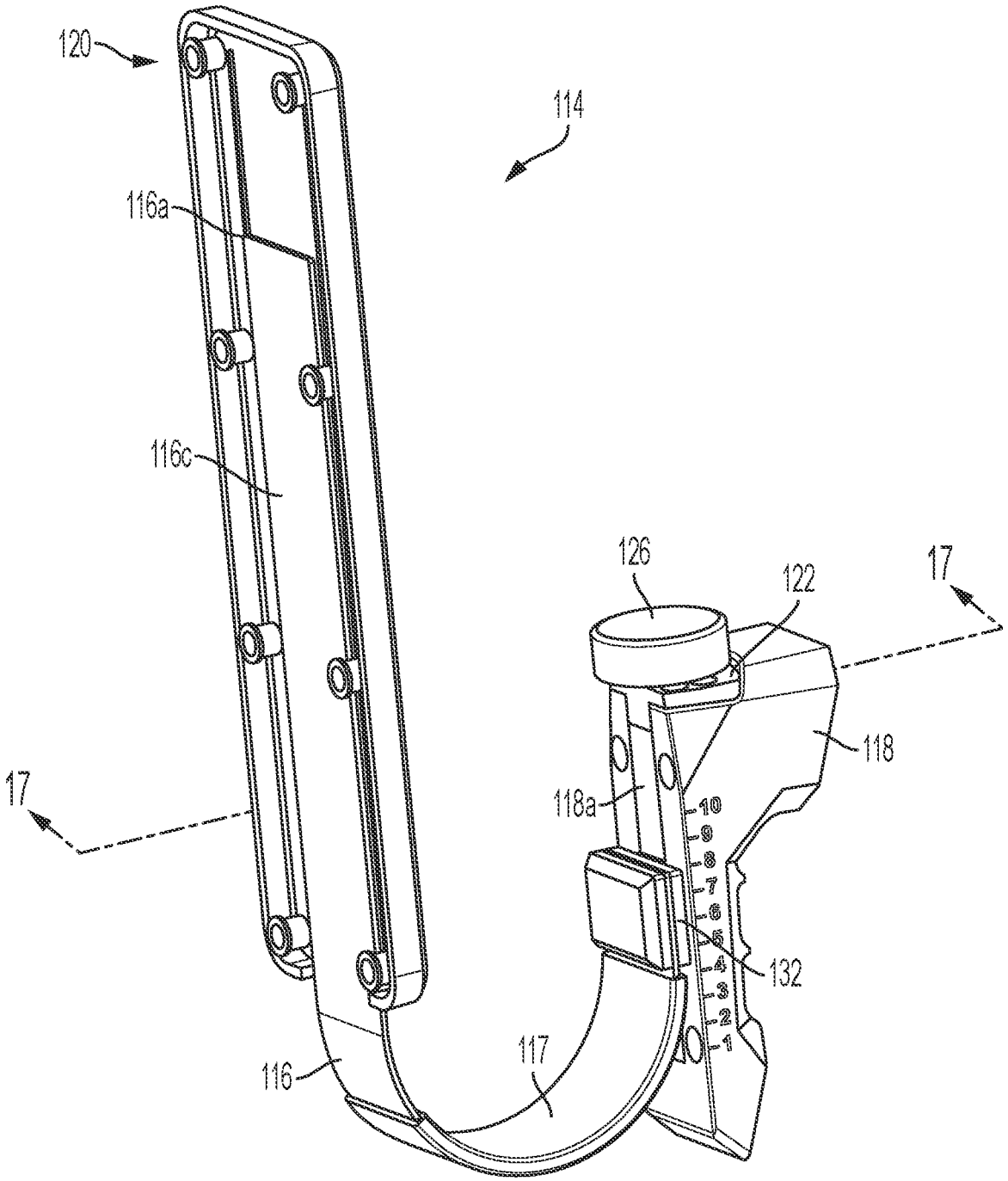
FIG. 15 is a perspective view of the force adjustment assembly of the rebounding device of FIG. 1.

As shown in FIG. 15, adjustment of the biasing force of the force adjustment assembly 114 is provided by moving the rear planar surface 116*d* of the third spring element 116 along a longitudinal channel 118*a* within a screw housing 118 mounted on an inner surface 104*a* of the back member 104. The force adjustment assembly 114 also includes a guide track 121 secured to an inner surface 102*a* of the front member 102 for receiving the front planar surface 116*c* of the third spring element 116.

Referring to FIGS. 18-21, the screw housing 118 has a longitudinal shape extending between an upper base portion 118*b* and a lower base portion 118*c*. The screw housing 118 is secured to the back member 104 by screws extending through upper and lower pairs of bores 118*e*, 118*f* are provided in the upper and lower base portions 118*b*, 118*c*, respectively, although any other suitable means of attachment may be used as desired or required due to manufacturing needs.

Figure 16:
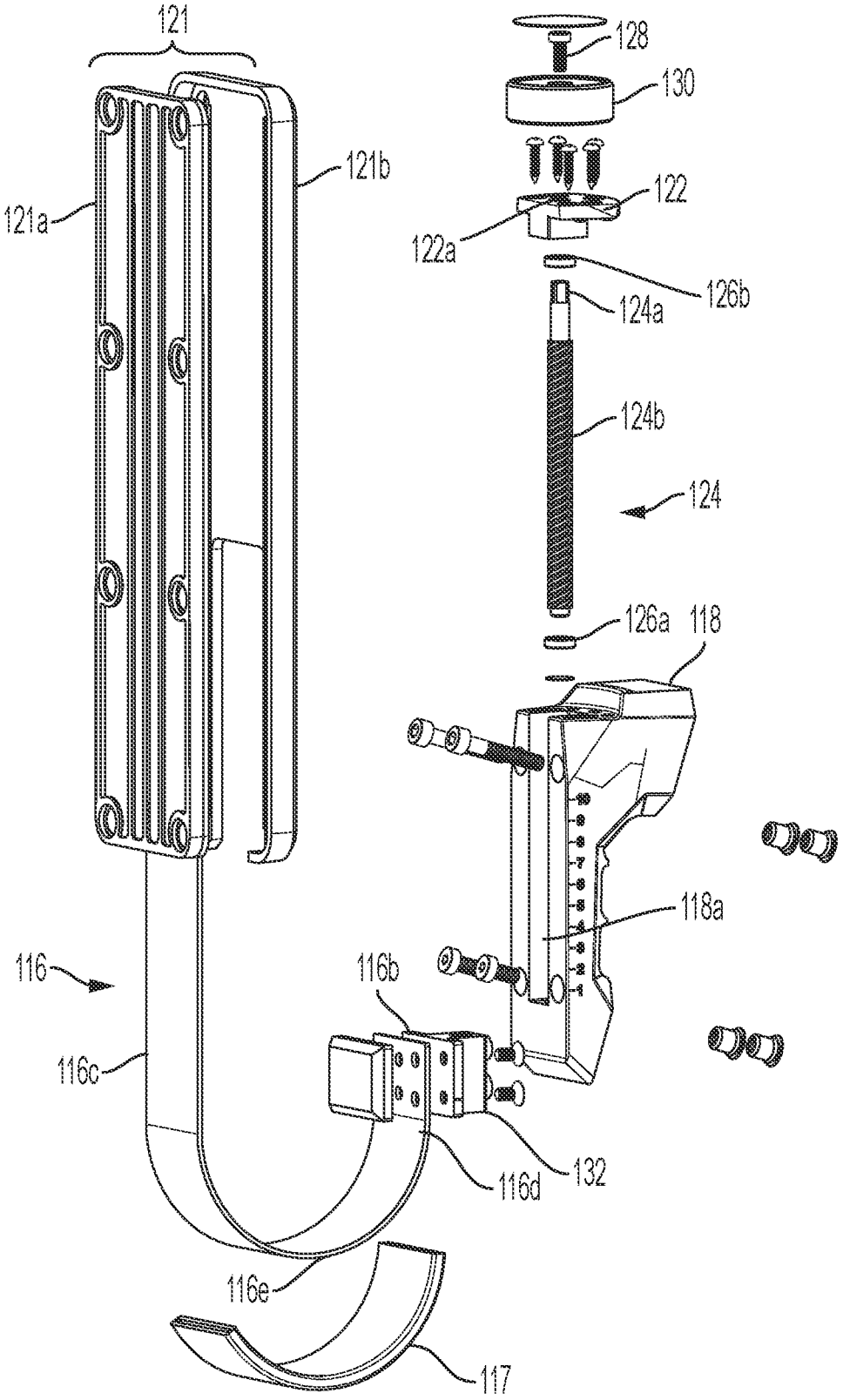
FIG. 16 is an exploded, perspective view of the force adjustment assembly of the rebounding device of FIG. 1.

Referring to FIG. 16, a screw housing cover 122 is secured to a correspondingly shaped platform 118*d* of the upper base portion 118*b* of the screw housing. The screw housing cover 122 includes a bore 122*a* aligned with the longitudinal channel 118*a* of the screw housing 118. The screw housing cover 122 may be secured to the screw housing 118 through screws, glue, or any other suitable means for securing.

Figure 17:
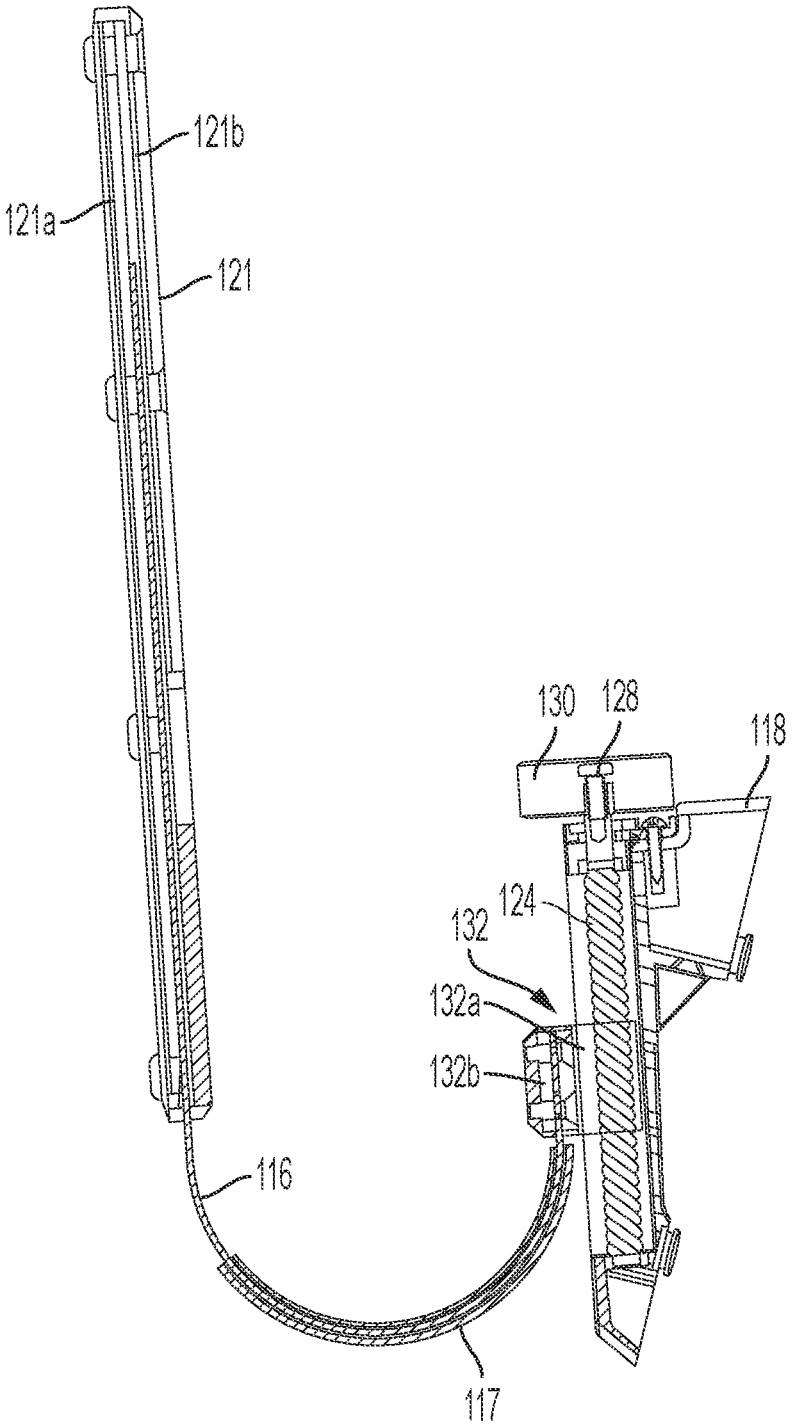
FIG. 17 is a cross-sectional view taken generally along lines A-A of FIG. 15 of the force adjustment assembly of the rebounding device of FIG. 1.
Figure 21:
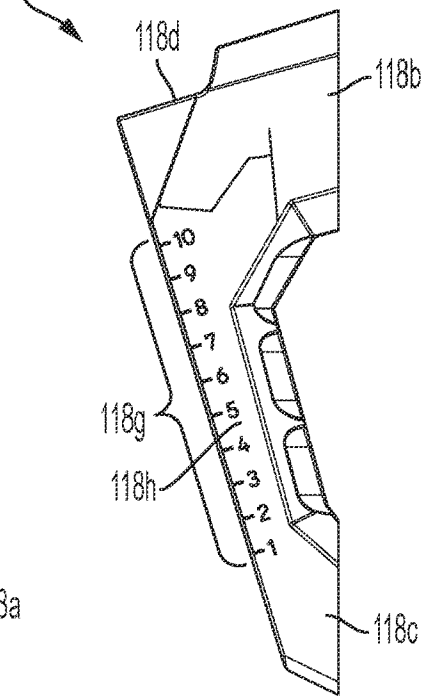
FIGS. 18-21 are front perspective, rear perspective, front elevational, and side elevational views of the screw housing of the force adjustment assembly of the rebounding device of FIG. 1.
Figure 20:
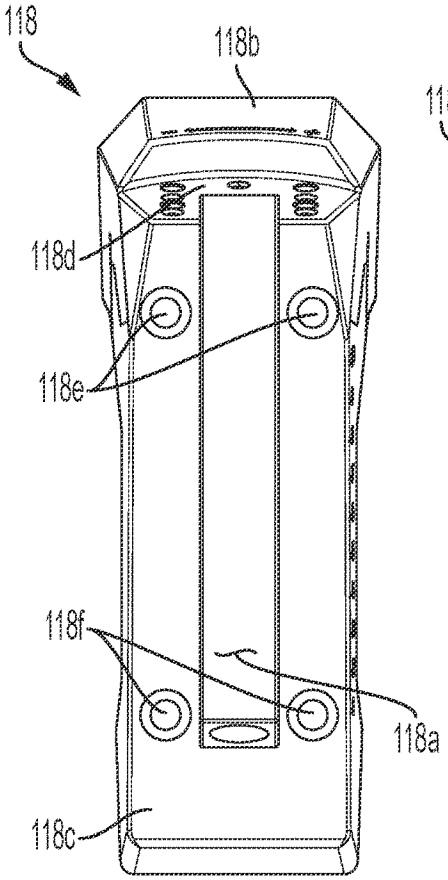
Figure 19:
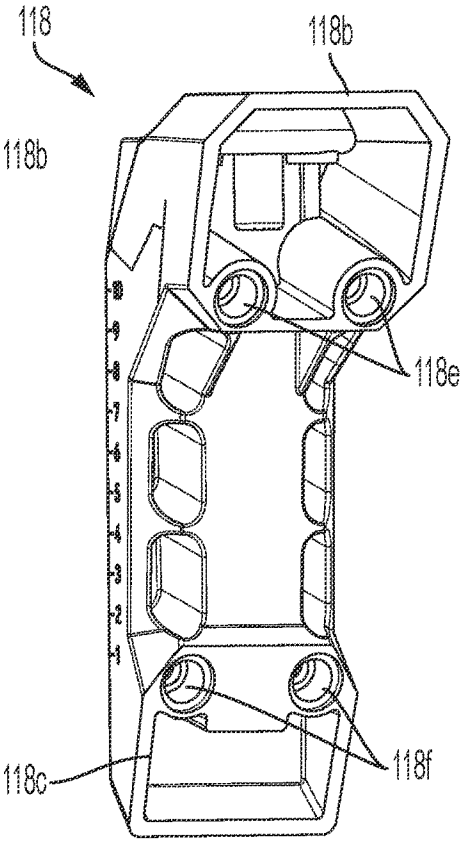
Figure 18:
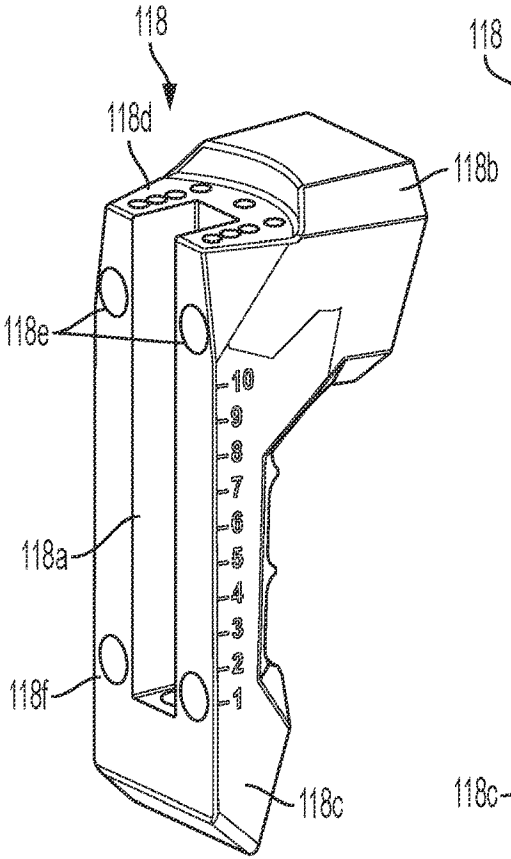

A drive screw 124 is positioned within the bore 122*a* and extends into the longitudinal channel 118*a* as shown in FIGS. 16 and 17. The positioning of the drive screw 124 within the screw housing 118 is secured through bearings 126*a*, 126*b* at opposing ends of the drive screw 124. A threaded screw 128 connects a knob 130 to an upper end 124 of the drive screw 124 above the screw housing cover 122.

Figure 22:
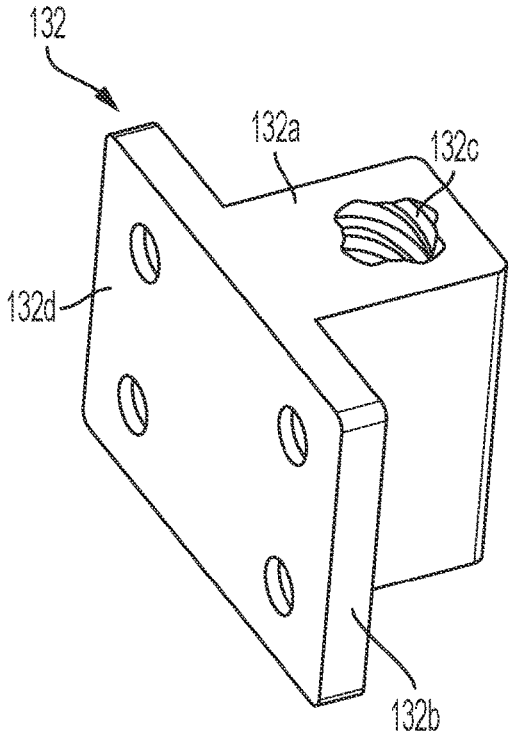
FIG. 22 is a perspective view of the threaded block of the force adjustment assembly of the rebounding device of FIG. 1.

As shown in FIGS. 16 and 22, a threaded block 132 includes an internal portion 132*a* that is positioned within the longitudinal channel 118*a* of the screw housing 118 and an external portion 132*b* that is located external to the screw housing 118. An outer shape of the internal portion 132*a* along a width thereof corresponds to the cross-sectional shape of the longitudinal channel 118*a*, and a threaded bore 132*c* extends through the internal portion 132 parallel to the height of the channel 118*b* for receive a shaft 124*b* of the drive screw 124*a*. In one embodiment, the height of the drive screw 124 is between about 120 mm and about 123 mm, and the height of the internal portion 132*a* of the threaded block 132 is about 25 mm. In other embodiments, the dimensions may vary as needed or desired. A cover element may be secured atop the rear planar surface 116*d* of the third spring element 116, with screws extending through the cover element, the rear planar surface 116*d* of the third spring element 116, and the threaded block 132. Rotation of the drive screw 124 within the channel 118 causes the threaded block 132 to move along the shaft 124*a* of the drive screw 124.

The external portion 132*b* is positioned outside of the longitudinal channel 118*a* of the screw housing 118. The external portion 132*b* is formed integrally with the internal portion 132*a* such that the external portion 132*b* also moves with the internal portion 132*a* as it moves along the drive screw 124. The external portion 132*b* provides a planar surface 132*d* onto which the rear end portion 116*b* of the third spring element 116 is attached. The rear planar surface 116*d* of the third spring element 116 may be secured to the threaded block 132 via screws an adhesive, or other attachment mechanism, or may be formed integrally with the third spring element 116. Rotation of the drive screw 124 causes the threaded block 132 to move vertically along the screw housing 118, which in turn causes the third spring element 116 to move vertically along the screw housing 118.

As shown in the embodiment illustrated in FIG. 16, the screw housing 118 may include notches or markings 118*g* along an outer surface 118*h* next to the longitudinal channel 118*a* so that the user can easily reference a positioning of the threaded block 132 along the channel 118*a* and make note of that notch 118*a* or positioning for future reference.

Figure 23:
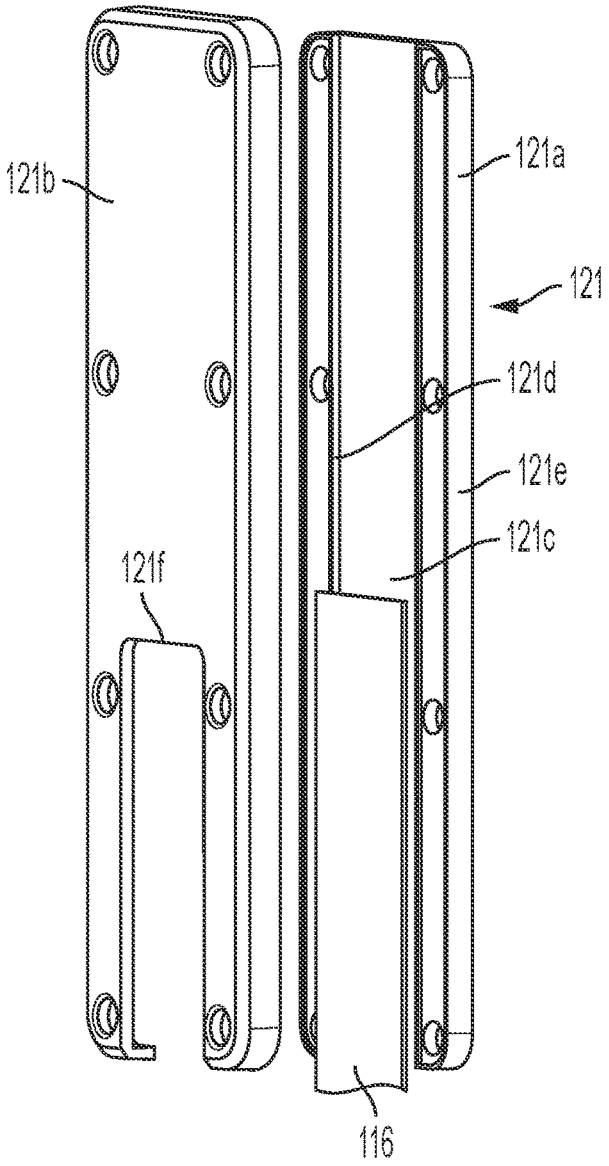
FIG. 23 is a perspective view of the guide track of the force adjustment assembly of the rebounding device of FIG. 1.

FIG. 23 illustrates a base element 121*a* and a cover element 121*b* of the guide track 121 that is secured to the inner surface 102*a* of the front member 102. The base element 121*a* includes a recessed track 121*c* between first and second raised side surfaces 121*d*, 121*e* with through which screws or other attachment means may extend. The cover element 121*b* provides a protective structure around the track 121*c* so that the front planar surface 116*c* of the third spring element 116 can move along the track 121*c* during use without obstruction. A cut-out 121*f* in the cover element 121*b* is provided for the third spring element 116 to move fully up and down along the screw housing 118.

Figure 4:
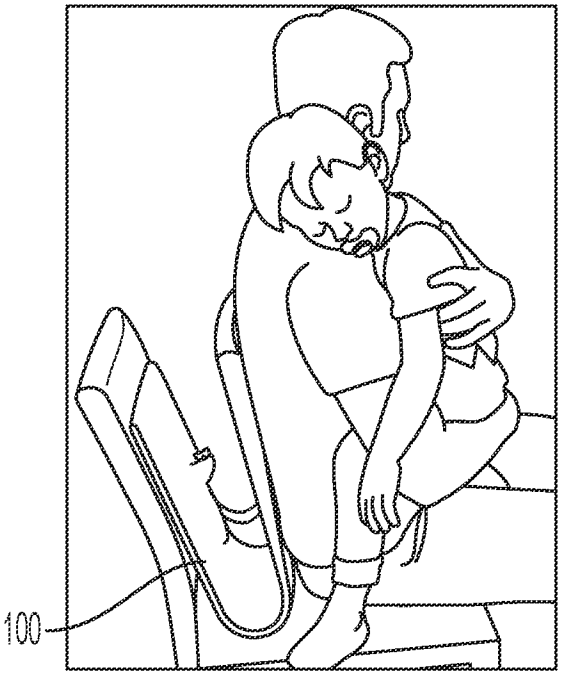
FIG. 4-6 illustrate the rebounding device of FIG. 1 in the decompressed, the partially compressed, and the compressed positions, respectively.

During use, the user positions the rear surface 104 of the device 100 against a stationary object such as a chair, wall, tree, etc. as shown in FIGS. 4-6. The user rests his back against the front member 102, and applies pressure to generate a gentle rocking motion to move the rebounding device 100 between a least compressed position and a most compressed position. The user can adjust the biasing force by rotating the knob 132 of the force adjustment assembly 114 as desired. In FIG. 4, the rebounding device 100 is in the least compressed position, with the front member 102 farthest from the rear member 104. FIG. 5 illustrates the rebounding device 100 in a partially compressed position, with the front member 102 mid-way to the rear member 104. FIG. 6 shows the rebounding device 100 in the most compressed position, with the front member 102 closest to the rear member 104. The spring mechanism 106 exerts a biasing force when compressed that propels the user's upper body forward while maintaining a seated position.

Figure 3:
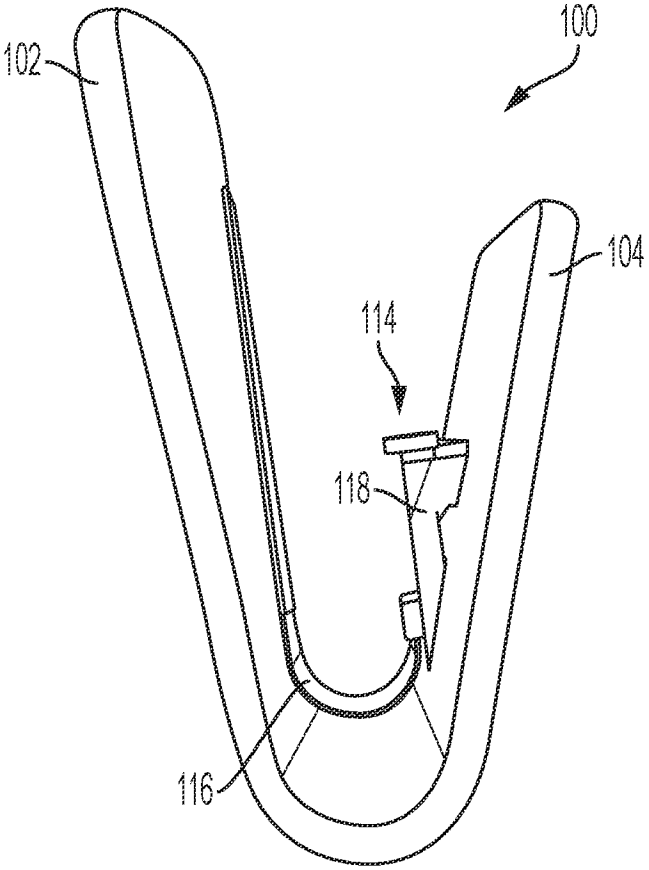
FIG. 3 is a top plan view of a front planar surface of a spring element of the rebounding device of FIG. 1.
Figure 2:
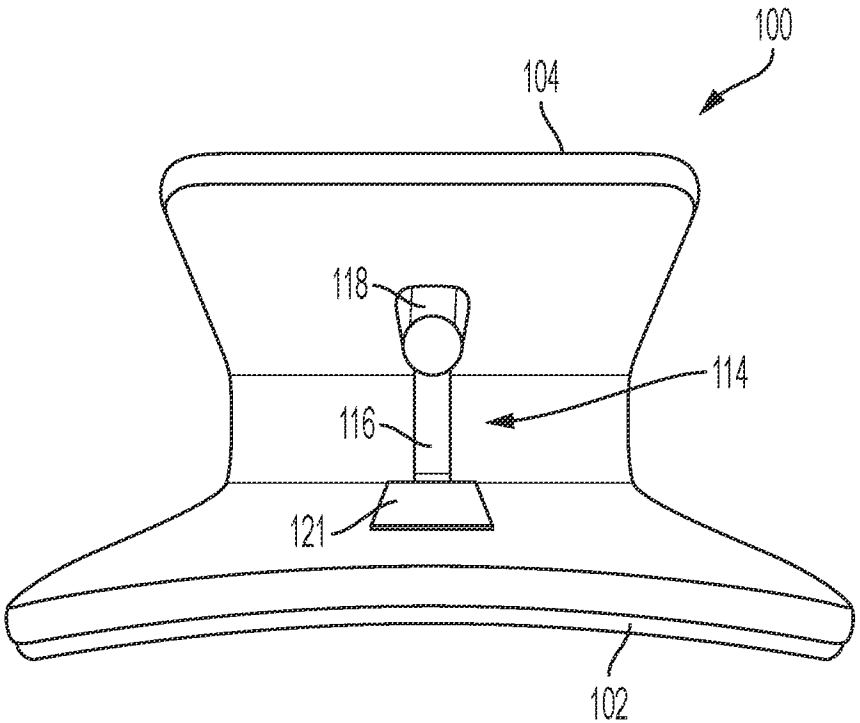
FIG. 2 is a side elevational view of the rebounding device of FIG. 1.

A foam pad, a rubber material such natural latex, or other thick, cushioning material may be secured to the front member 102 or the flexible material and may optionally be encapsulated within the outer housing material 107 as shown in FIGS. 1-3. The housing material 107 may extend around the entire rebounding device 100, may be limited to surrounding the front member 102 and the front planar surfaces 110*c*, 112*c* of the spring elements 110, 112 as well as the rear member 104 and the rear planar surfaces 110*d*, 112*d* of the spring elements 110, 112, or another other select portion of the rebounding device 100. The housing material 107 may be a plastic such as a polyvinyl chloride, a carbon fiber composite material, a leather material, or any other suitable material. In some embodiments, the housing may also include a plurality of layers, including one or more of the following: a cushioning material, a rubber material, a para-aramid synthetic fiber material such as Kevlar, and a fabric or leather outer layer. In a still further embodiment, each of the front and rear members 102, 104 may comprise a fabric material that includes tubular portions for receiving front and rear planar portions of the spring elements. The dimensions of the fabric front and rear members is sufficiently taut so as to support the user's weight and a bouncing force.

In other embodiments, the components of the rebounding device 100 may be formed integrally. For example, the front member 102, the rear member 104, and the first and second spring elements 110, 112 may be formed integrally. In one embodiment, the rebounding device 100 may be comprised of a metal such as an aluminum alloy, that is stamped, laser cut, water-jetted, or otherwise cut from a sheet of the material and pressed into formation. In other embodiments, the rebounding device 100 may comprise a wooden material shaped into formation. In still further embodiments, the rebounding device 100 may be a polyvinyl chloride material that is that is molded, such as injection molded, into formation. The material and method of manufacture may vary based on the manufacturing process or as desired.

In still further embodiments, the spring mechanism 106 may be modified to include one or more reinforcing spring elements that provide additional elasticity and/or strength to account for heavier users. The number, position, and location of reinforcing elements may vary as desired or, in some embodiments, based on the user's preference. In some embodiments, the reinforcing spring elements added to the first, second, and third spring elements 110, 112, 116 and/or to any part of the spring mechanism 106 may be adjustable.

For example, reinforcing spring elements like the reinforcing spring element 117 described above with reference to the third spring element 116 may be secured to the rounded portions 110*e*, 112*e* of the first and second spring elements 110, 112. Each reinforcing spring element has a length that extends along the rounded portion 110*e*, 112*e* of the spring element 110, 112. In one embodiment, the reinforcing spring elements are welded or otherwise secured to the respective rounded portion 110*e*, 112*e*. In other embodiments, the reinforcing spring elements may be snapped into place or otherwise added only if desired.

In other embodiments, a reinforcing spring element may be secured along the inner surface of the rounded portions 110*e*, 112*e* of the first and second spring elements 110, 112. Such reinforcing spring elements may be attached to the first and second spring elements 110, 112 through a frame component, the reinforcing element being positioned along but not secured to the inner surface of the rounded portions 110*e*, 112*e*, 116*e*. The frame may include components connected to the front member 102, the rear member 104, and/or the spring elements 110, 112, 116.

In still further embodiments, the reinforcing element comprises a torsion spring that may be adjusted. In still further embodiments, the reinforcing spring element may include one or more torsion springs, one or more leaf springs or a Z-shaped spring that is secured to the inner surface 104*a* of the rear member 104 between the spring elements 110, 112. In this embodiment, leaf springs may be secured to the inner surface 104*a* of the rear member 104 and provide resistance against the front member 102 only when a significant amount of pressure is applied by a user to the front member 102 during use.

In other embodiments, one or more reinforcing spring elements are added to one or more of the following locations: inside or outside of the rounded portion 110*e*, 112*e* of the spring elements 110, 112, between the front and rear planar surfaces 110*c*, 112*c* and 110*d*, 112*d* of each spring element 110, 112, and between the front and rear members 102, 104. The use of reinforcing spring element(s) enables the rebounding device 100 to be used by a heavier person and to increase the life of the spring elements 110, 112. The ability to optionally add and/or adjust reinforcing spring elements also enables the rebounding device to be purchased for a single home and used for people of various sizes.

In still further embodiments, the rebounding device 100 may include first and second rubber guards that extend along the rounded portions 110*e*, 112*e* of the spring members 110, 112. The rubber guards may include treaded portions that prevent the rebounding device 100 from slipping on the floor, the seat of a chair, or other surface during use.

The rebounding device 100 may also include first and second structural members that, when in use, support the rebounding device to be used on its own without being positioned against a structural support such as the back of a chair or a wall. In one embodiment, the first and second structural members are hingedly attached to the rear planar portions 116*a*, 116*b* of the first and second spring members 108*a*, 108*b*, respectively, so that they rotate between an open position and a closed position. In the closed position, the structural members are secured to the rear planar portions 116, allowing the rebounding device 100 to be used against a structural surface such as a chair, a wall, or the like, as described above. When the structural members are in the open position, they extend away from the rear planar portions 110*d*, 112*d* so that the rear planar portions 110*d*, 112*d* form an acute angle with the surface on which the rebounding device 100 is positioned. The user can then lean against the rebounding device 100, creating the rocking motion without the need for a piece of furniture or other structural support.

The dimensions of the rebounding device 100 may be modified in order to tailor the device to a specific use. For example, the width of the first and second spring elements 110, 112 of the rebounding device 100 may be wider than illustrated herein in order to accommodate for usage with a wheelchair or a hospital bed.

As described above, the rebounding device can be used in a variety of applications, from rocking an infant to sleep to the comfort and benefit for those with conditions such as dementia, anxiety, and autism. It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A rebounding device comprising:

a front member;

a rear member; and a spring mechanism including a first biasing element and a force adjustment assembly, wherein the force adjustment assembly includes:

a spring element including a front planar surface and a rear planar surface connected at a rounded portion, wherein the front planar surface contacts an inner surface of the front member;

a screw housing secured to an inner surface of the rear member, wherein the screw housing includes a channel and a bore on an upper surface;

a drive screw positioned through the bore and along the channel of the screw housing, the drive screw includes first and second bearings positioned at first and second ends of the drive screw and a knob secured to the first end of the drive screw and a knob secured to the first end of the drive screw through a threaded screw;

a threaded block positioned within the channel of the screw housing, wherein the threaded block engages the drive screw and is configured to move vertically along the channel, and wherein the rear planar surface of the spring element is secured to the threaded block.

2. The rebounding device of claim 1, wherein the threaded block includes an internal portion and an external portion, the internal portion being positioned within the channel of the screw housing and configured to move along a shaft of the drive screw and the external portion being located outside of the channel, wherein the rear planar surface of the spring element is attached to the external portion.

3. The rebounding device of claim 1, wherein the biasing element includes second and third spring elements, each having a length and a width, wherein the length is greater than the width, and wherein the second and third spring elements are curved about an axis parallel to the width.

4. The rebounding device of claim 3, wherein each of the second and third spring elements comprises a front planar portion, a rear planar portion, and a rounded portion between the front and rear planar portions.

5. The rebounding device of claim 4, wherein a first front end of the front planar surface of the second spring element distal from the rounded portion includes an inner edge and an outer edge, and wherein the inner edge forms an angle relative to a line parallel to the rear planar surface, wherein the angle is between 0 and 90 degrees.

6. A rebounding device comprising:

a front member;

a rear member; and a spring mechanism including a first spring element, a second spring element, and a force adjustment assembly, wherein the force adjustment assembly includes:

a third spring element including a front planar surface and a rear planar surface connected at a rounded portion, wherein the front planar surface contacts an inner surface of the front member;

a screw housing secured to an inner surface of the rear member, wherein the screw housing includes a longitudinal channel and a bore on an upper surface;

a drive screw positioned through the bore and along the longitudinal channel of the screw housing;

a threaded block positioned within the longitudinal channel of the screw housing, wherein the threaded block is configured to move vertically along the longitudinal channel, and wherein the rear planar surface of the third spring element is secured to the threaded block;

wherein the movement of the third spring element is along the longitudinal channel of the screw housing.

7. The rebounding device of claim 6, wherein a second front end of the front planar surface of the third spring element distal from the rounded portion includes an inner edge and an outer edge, and wherein the inner edge forms an angle relative to a line parallel to the rear planar surface, wherein the angle is between 0 and 90 degrees.

8. The rebounding device of claim 6, wherein the threaded block includes an internal portion and an external portion, the internal portion being positioned within the channel of the screw housing and configured to move along a shaft of the drive screw and the external portion being located outside of the channel, wherein the rear planar surface of the spring element is attached to the external portion.

9. The rebounding device of claim 6, wherein the first and second spring elements have a length and width, wherein the length is greater than the width, and wherein the first and second spring elements are curved about an axis parallel to the width.

10. The rebounding device of claim 6, wherein a first front end of the front planar surface of the second spring element distal from the rounded portion includes an inner edge and an outer edge, and wherein the inner edge forms an angle relative to a line parallel to the rear planar surface, wherein the angle is between 0 and 90 degrees.

11. The rebounding device of claim 6, wherein a second front end of the front planar surface of the third spring element distal from the rounded portion includes an inner edge and an outer edge, and wherein the inner edge forms an angle relative to a line parallel to the rear planar surface, wherein the angle is between 0 and 90 degrees.

* * * * *